US008523484B2

(12) United States Patent
McFarland

(10) Patent No.: US 8,523,484 B2
(45) Date of Patent: Sep. 3, 2013

(54) WAVE GENERATING APPARATUS AND METHOD

(76) Inventor: Bruce McFarland, Solana Beach, CA (US)

( * ) Notice: Subject to any disclaimer, the term of this patent is extended or adjusted under 35 U.S.C. 154(b) by 21 days.

(21) Appl. No.: 12/700,042

(22) Filed: Feb. 4, 2010

(65) Prior Publication Data

US 2010/0135727 A1 Jun. 3, 2010

Related U.S. Application Data

(63) Continuation-in-part of application No. 11/550,239, filed on Oct. 17, 2006, now Pat. No. 7,658,571.

(51) Int. Cl.
*E02B 3/00* (2006.01)

(52) U.S. Cl.
USPC ..... 405/79; 472/128

(58) Field of Classification Search
USPC ..... 405/79, 76; 472/117, 128; 4/491
See application file for complete search history.

(56) References Cited

U.S. PATENT DOCUMENTS

| | | | | |
|---|---|---|---|---|
| 3,913,333 | A * | 10/1975 | Hubbard, Jr. | 405/31 |
| 4,537,143 | A * | 8/1985 | Gaide | 441/79 |
| 5,443,326 | A * | 8/1995 | Bernard et al. | 405/25 |
| 6,019,547 | A * | 2/2000 | Hill | 405/79 |
| 6,336,771 | B1 * | 1/2002 | Hill | 405/79 |
| 6,957,662 | B2 * | 10/2005 | Lochtefeld et al. | 137/565.33 |

OTHER PUBLICATIONS http://commons.wikimedia.org/wiki/File:Elevon.f117.arp.750pix.jpg.*
http://en.wikipedia.org/wiki/Hydraulic_jump.*

* cited by examiner

*Primary Examiner* — Sean Andrish
(74) *Attorney, Agent, or Firm* — Manuel de la Cerra

(57) ABSTRACT

The teachings herein are directed to a wave forming apparatus and method including a channel directing a flow of water over modular forms in the bed of the channel, such as aerofoils, that can be changed, repositioned or removed to create various effects such as barrel waves for surfing. Also disclosed is a water smoothener system and method for reducing turbulence in water flowing through such an apparatus.

19 Claims, 11 Drawing Sheets

WAVE GENERATING APPARATUS AND METHOD

RELATED APPLICATION

The present application claims the benefit of co-pending application Ser. No. 11/550,239 for a Barreling Wave Generating Apparatus and Method, filed Oct. 17, 2006.

BACKGROUND

1. Field of the Invention

The present invention relates generally to a wave forming apparatus for water rides or water features of the type provided in water-based amusement parks, water features in ornamental gardens, and the like, and is particularly concerned with an apparatus for forming a barreling wave, also known as a tubing or tunneling wave, which can support surfing activities or produce an attractive visual effect in a fountain or the like.

2. Related Art

Naturally occurring waves occur in the ocean and also in rivers. These waves are of various types, such as moving waves which may be of various shapes, including tubular and other breaking waves. Surfers are constantly searching for good surfing waves, such as tubular breaking waves and standing waves. There are only a few locations in the world where such waves are formed naturally on a consistent basis. Thus, there have been many attempts in the past to create artificial waves of various types for surfing in controlled environments such as water parks. In some cases, a sheet flow of water is directed over an inclined surface of the desired wave shape. Therefore, rather than creating a stand-alone wave in the water, the inclined surface defines the wave shape and the rider surfs on a thin sheet of water flowing over the surface. In some cases, the inclined surface is shaped to cause a tubular form wave. Sheet flow wave simulating devices have some disadvantages. For example, since these systems create a fast moving, thin sheet of water, they produce a surfing experience different than a real standing wave.

In other wave forming devices, a wave is actually simulated in the water itself, rather than being defined by a surface over which a thin sheet of water flows. U.S. Pat. No. 6,019,547 to Hill describes a wave forming apparatus which attempts to simulate natural antidune formations in order to create waves. A water-shaping aerofoil is disposed within a flume containing a flow of water, and a wave-forming ramp is positioned downstream of the aerofoil structure. Various apparatus and methods for forming deep water standing waves are described in the following United States Patents and applications, the entire contents of which are incorporated herein by reference: U.S. Pat. Nos. 6,629,803, 6,932,541 and 7,326,001, as well as U.S. patent application Ser. No. 11/550,239 for a Barreling Wave Generating Apparatus and Method, filed Oct. 17, 2006; U.S. patent application Ser. No. 11/958,785 for a Wave Forming Apparatus and Method, filed Dec. 18, 2007; and U.S. patent application Ser. No. 12/356,666 for an Adjustable Barreling Wave Generating Apparatus and Method, filed Jan. 21, 2009.

SUMMARY

Among other things, provided is a wave generating apparatus that includes a channel having sides and a bottom, where the channel is adapted to direct a flow of water into contact with an object removably fastened to the channel and located at least partially inside the channel, such that the channel and the object are together adapted to generate a standing barreling wave capable of supporting a person surfing when the flow of water contacts the first object. In various example embodiments the first object may be removably fastenable to the channel in a plurality of locations and orientations, such as at an oblique angle to the water flow. Any number of additional objects may be removably fastened to the channel and located at least partially inside the channel to create similar or combined effects. The objects may include a foil, or airfoil/aerofoil, weir, spoiler, or any similar object. In one example location and orientation in a channel, an object may be located a certain distance from the first side of the channel to create a venturi effect between the first object and the first side of the channel when the flow of water contacts the object. The object may also be located adjacent either, neither, or both sides of the channel. A water drain may also be located adjacent one or both sides of the channel.

Also provided is a modular device for forming a barreling wave, including an airfoil shaped member having a front face, a rear face, a peak, and a base, where the modular device is adapted for removably mounting in a first location in a channel, and the channel is adapted to direct a flowing stream of water, such that the front face faces into the water stream direction, where the modular device is further adapted to generate a standing barreling wave when the modular device is mounted in the first location in the channel and the flowing stream of water contacts the modular device. The modular device may be further adapted for removably mounting in a second location and/or orientation in the channel. In various embodiments the modular device may include one or more sections adapted to be repeatedly assembled and disassembled with each other to change the size or shape of the modular device.

Further provided is a method of forming a standing barreling wave, including the steps of positioning a removable foil member to project upwardly from a first location in the base of a channel with the removable foil member at a first predetermined orientation to a water stream direction defined by the channel, and supplying a flowing stream of water to an inlet end of the channel towards the removable foil member, whereby a standing barreling wave is formed when at least part of the water stream contacts the foil member. The method may also include repositioning the removable foil member to project upwardly from a second location and/or orientation in the channel.

Other features and advantages of the present invention will become more readily apparent to those of ordinary skill in the art after reviewing the following detailed description and accompanying drawings.

BRIEF DESCRIPTION OF THE DRAWINGS

Details of the present invention, both as to its structure and operation, may be determined in part by study of the accompanying drawings, in which like reference numerals refer to like parts, and in which.

DETAILED DESCRIPTION

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

1. An Example Wave Forming Apparatus

Figure 1:
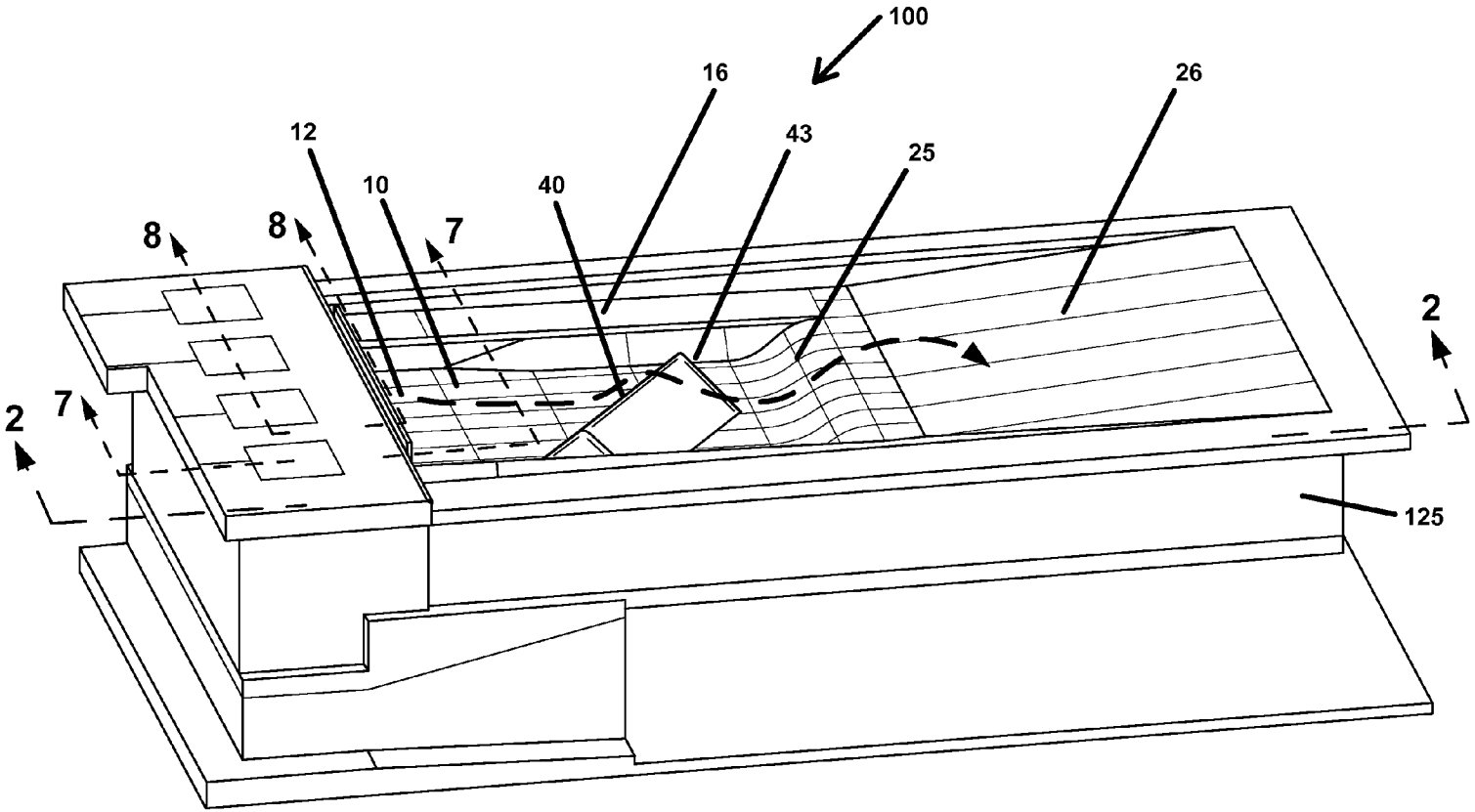
FIG. 1 is a perspective view of a wave forming apparatus of an example embodiment having a single oblique foil.
Figure 2:
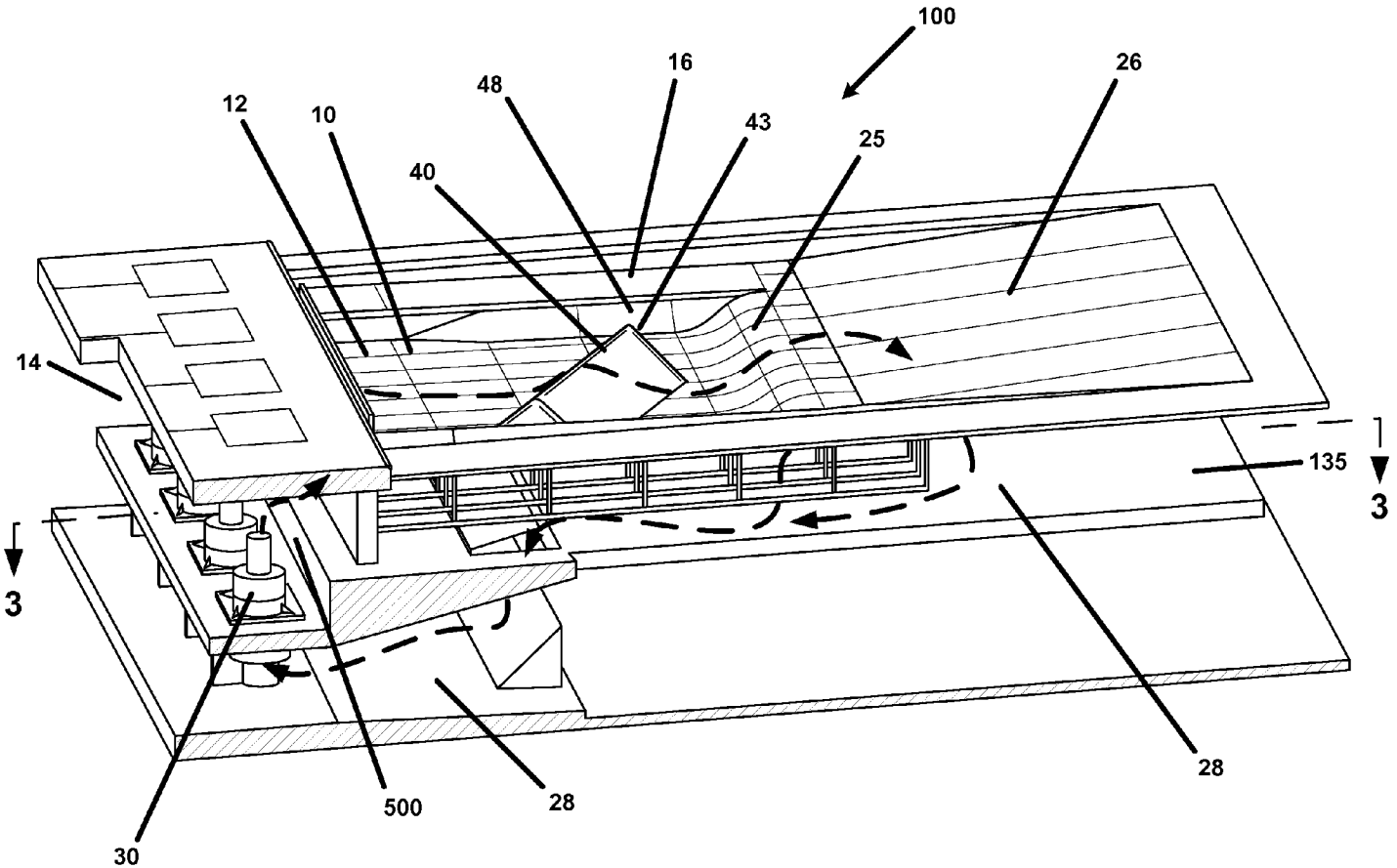
FIG. 2 is a cross-sectional perspective view along the line A'-A of FIG. 1, showing pumps and flow of water in that embodiment.

FIGS. 1, 2, 3, 4, 7, 8, 9A and 11 illustrate a first example embodiment of an improved wave forming apparatus 100 designed to form barreling waves. An apparatus 100 may comprise an outer housing 125 having a water supply or reservoir 14 at one end and channels 28 extending from the reservoir 14 to the opposite or exit end of the ride for containing a flow of water. As best illustrated in FIG. 2, channel(s) 28 may have at least one base or lower wall 135. Water is recirculated from the exit end of the ride along channels 28 back to the reservoir 14, under the action of one or more pumps 30. Except as otherwise provided herein, an example wave forming apparatus 100 may be similar to the apparatus described with respect to FIGS. 39-41 in pending application Ser. No. 11/958,785 filed Dec. 18, 2007, the contents of which is incorporated herein by reference.

Figure 9A:
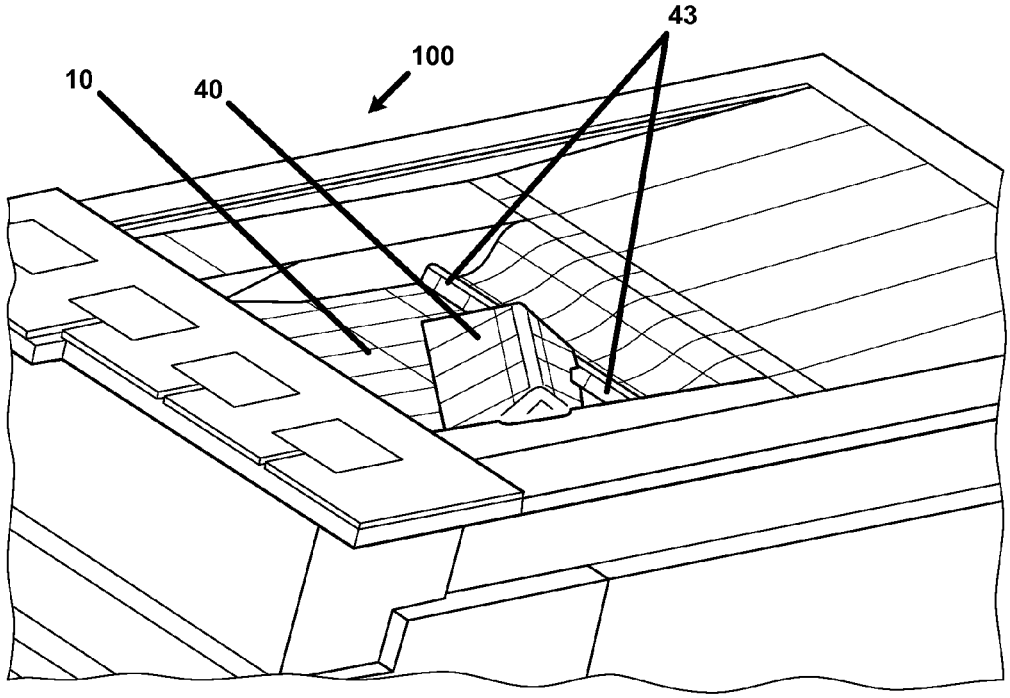
FIG. 9A is a perspective view, partly cut away, of the top of a wave forming apparatus with an example modular foil positioned in a first position and orientation partially overlapping an example modular spoiler ridge.
Figure 11:
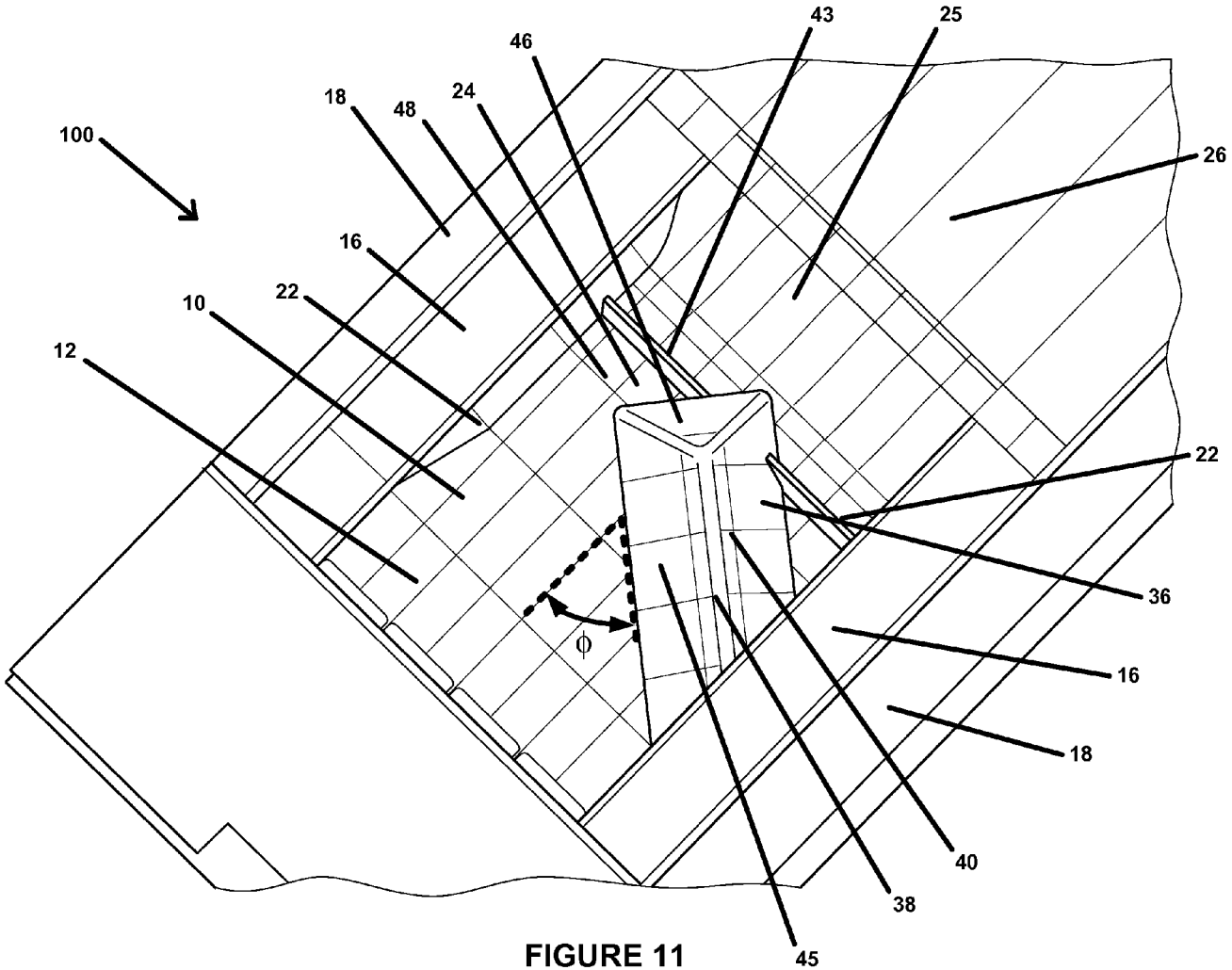
FIG. 11 is a top view, partly cut away, of a wave forming apparatus with an example modular foil positioned in a first position and orientation partially overlapping an example modular spoiler ridge.

Optional river banks or entry/exit portions 16 may extend outwardly from opposite side walls 22 of the wave forming channel 10 to the outer sides 18 of the apparatus, which may be spaced outwardly from the outer sides of channel 10, as illustrated for example in FIG. 11. The outer side walls 18 in any of the above embodiments could be eliminated so that water could flow off opposite sides of the apparatus, for example into an adjacent pool or river. In that case, the adjacent pool or river may be at or close to the same elevation as the river bank. Side river banks or beaches 16 may extend outwardly from opposite sides of the channel 10 to provide for ride entry and exit. These may be completely horizontal in the transverse direction, or have a slight downward slope, rather than being inclined upwardly, as illustrated in FIGS. 17 and 41, respectively, of my U.S. patent application Ser. No. 11/958,785 filed Dec. 18, 2007, which is incorporated herein by reference. Regardless of the transverse angle of the side beaches 16, each beach may have a slight downward slope in the longitudinal direction from the inlet end or reservoir end to the exit end, as illustrated in FIGS. 1, 2 and 9A. The slope may be sufficient to allow water to drain, so that wave control is maintained. The slope of the side beaches 16 may be around 2.5%, but a slope of 1% is sufficient in most cases. The side beaches 16 may also include drains for providing a secondary flow path for the water to drain into channels 28, as indicated in FIG. 2. Not only do river banks 16 allow drainage around the foil 40 while containing water within outer containment walls 18, they also facilitate entry and exit of the ride. A drainage-capable river bank 16 may only be needed on the side of apparatus 100 adjacent the venturi 48, where the large barrel wave tends to form. However, example apparatus 100 is adapted to locate the oblique foil 40, and thus the venturi 48, on either side of the channel 10. Accordingly, example apparatus 100 includes drainage-capable river banks 16 on both sides of the channel 10, as shown in FIG. 11. In one embodiment the channel 10 is sixteen feet wide between the walls 22, while the river banks 16 are each an additional four feet wide. The channel 10 may alternatively be made wider and deeper, but this might not be practical for entry and might require more water flow and expense to operate.

A weir bed form or first bed form 12 may be formed at the exit from the reservoir 14, and at least one additional bed form, such as one or more aerofoils or foils 40, one or more spoilers 43, and/or a secondary or beta foil 25, may be spaced downstream from the weir bed form 12, as shown in FIG. 11. The example bed forms 12, 40, 43 and 25 of this embodiment may be of hollow construction, and may have vents for providing additional flow paths for the water to drain into channels 28. The bed forms may alternatively be of solid or any other appropriate construction. Weir bed form 12 may have a peak at its leading end and then slope downwardly, for instance at a one or two percent decline, to an extended, generally flat or horizontal floor 24, with an optional spoiler 43 located at the trailing end of floor 24. The secondary or beta foil 25 may have an upwardly inclined upstream face extending into an extended flat tail drain section 26. Extended flat tail drain section 26 may comprise an upwardly inclined exit grating or beach that extends from the end of the channel 10 toward the end of the housing 125. Water draining through the grating 26 may be returned to the channels 28 and flow back to the reservoir 14.

In addition to the bed forms described above, one or more barreling wave forming foils 40 may be mounted in the channel 10 in, for instance, a generally oblique formation with a leading face 45 facing upstream. As shown with respect to one embodiment depicted in FIGS. 1, 2, 3, 4, 7, 8, 9A and 11, a foil 40 may face opposite side walls 22 of the channel 10 at an oblique angle to the flow direction of water along the channel 10.

As best illustrated in FIG. 11, the channel 10 may have a base or lower wall 24 and the weir or alpha foil 12 is formed in the base wall at the inlet end of the channel 10 so as to direct water from reservoir 14 into a flowing stream of relatively deep water along channel 10, as described in my prior patents and application referenced above. One or more beta foils 25 for forming a standing wave may be located downstream of alpha foil 12 and oblique foil 40, with a spoiler or small bump 43 in the floor prior to secondary or beta foil 25, but this is not essential and no additional foils may be provided downstream of oblique or barreling wave forming foils in other embodiments. A grating 26 or the like is provided at the outlet end of the channel in this embodiment, and water is returned via a passageway 28 extending under floor 24 and pumped by pumps 30 back into the reservoir 14. In an alternative embodiment, water could be returned by running out of the channel into a river or pool.

Although a weir or alpha foil 12 is used in the illustrated embodiments to direct a stream of water along channel 10, in alternative embodiments the desired stream condition could be created with a tank and sluice gate or nozzle. The opposite side walls 22 of the channel may be straight, as illustrated, or may taper outwardly from the inlet end to the outlet end of the channel, and define a primary flow path for water through the channel, as described in my prior patents and application referenced above.

2. Modular Bed Forms

While bed form shapes have been permanently formed into the profile of channels 10, according to the present invention bed forms may also comprise separate modular components that can be removably secured in the channel 10 in various locations and positions as desired. For instance, the weir bed form or first bed form 12, foils 40, spoilers 43, and secondary or beta foils 25 may each be separately constructed modular components adapted to be attached to, removed from, repositioned in and reoriented in channel 10. While any appropriate fastening or restraint means may be used, in one embodiment an array of fastener couplings may be provided under removable covers recessed in the floor 24 and/or side walls 22 of channel 10 corresponding to potentially desirable locations and positions of one or more of the bed forms. The bed forms can then be removably attached to the floor 24 and/or side walls 22 with corresponding removable fasteners, such as threaded fasteners. Alternatively, modular bed forms can be removably attached to actuators or other mechanisms adapted to adjust the position or shape of the bed forms during or between uses of the apparatus 100 as discussed in my prior applications incorporated herein.

Figure 9B:
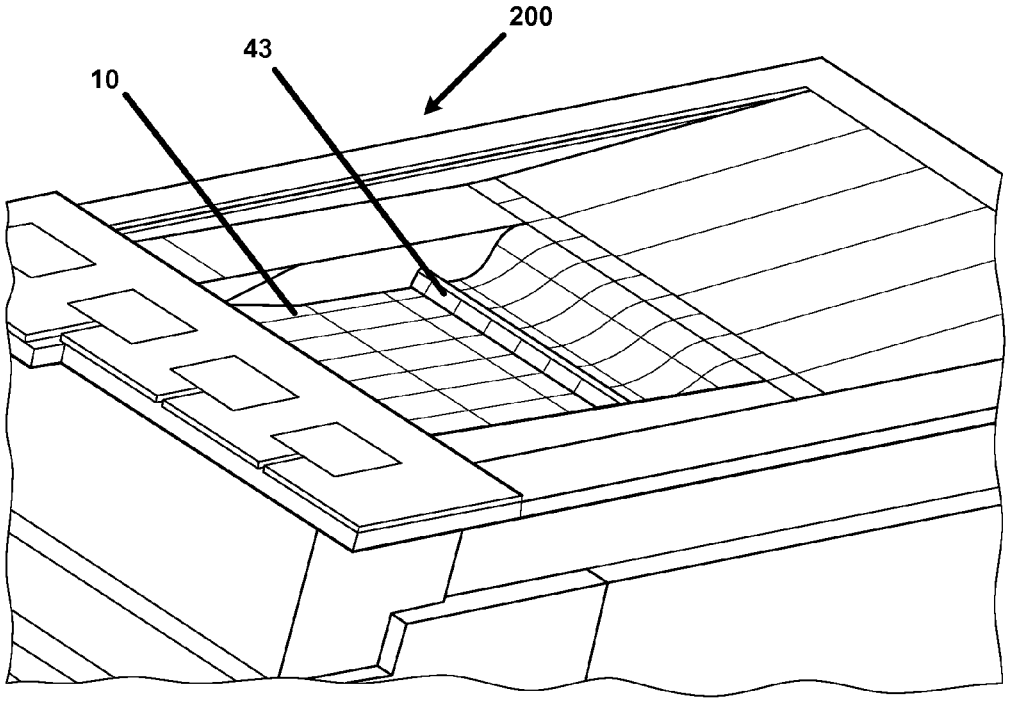
FIG. 9B is a perspective view, partly cut away, of the top of the wave forming apparatus of FIG. 9A with the example modular foil removed.
Figure 9C:
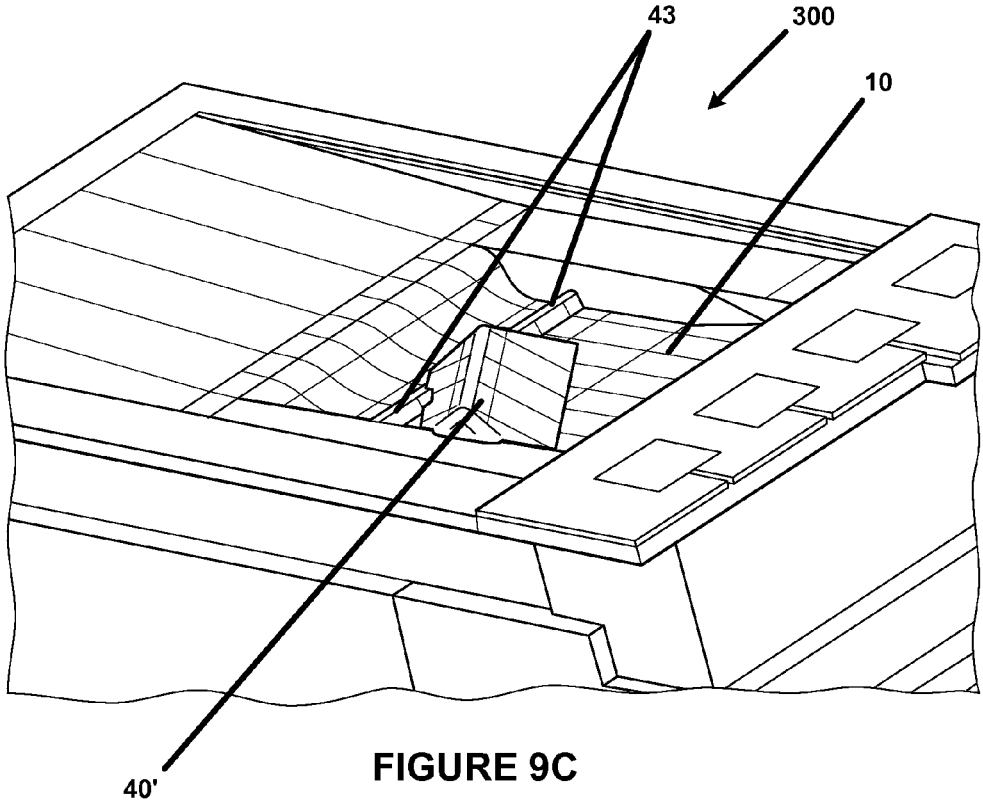
FIG. 9C is a perspective view, partly cut away, of the top of the wave forming apparatus of FIG. 9A with the example modular foil positioned in a second position and orientation.

By way of example, FIGS. 9A, 9B and 9C depict three different applications utilizing a modular bed form. In FIG. 9A apparatus 100 is shown with modular foil 40 attached to the floor 24 of the channel 10 at a first oblique angle and abutting left-side wall 22. FIG. 9B depicts apparatus 200, which is apparatus 100 with modular foil 40 optionally removed from channel 10. FIG. 9C shows apparatus 300, which is apparatus 100 with modular foil 40' attached to the floor 24 of the channel 10 at a second oblique angle and abutting right-side wall 22. It is understood that modularity of bed forms permits not only addition, removal, replacement and repositioning of bed forms as shown in FIGS. 9A-9C, but also stacking and/or intermixing of bed forms to create, for instance, longer or shorter foils, weirs and spoilers, as well as differently-sized and shaped foils, weirs and spoilers, among other options that would become apparent to one of skill in the art. Modular bed forms may be rigid devices or may be hollow, inflatable devices that can be inflated or deflated as desired by a ride operator.

Figure 10:
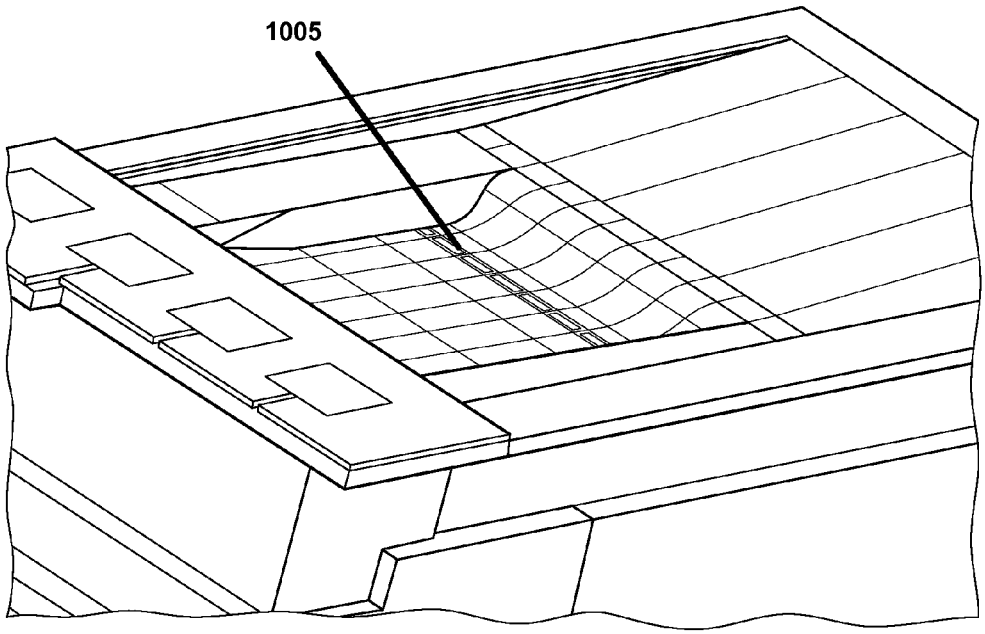
FIG. 10 is a perspective view, partly cut away, of the top of the wave forming apparatus of FIG. 9A with the example modular foil removed and the example modular spoiler ridge removed.

In addition to the modular foils 40, 40', any other bed forms may also be modular. For example, FIG. 10 depicts apparatus 200 further modified by optionally removing modular spoiler 43 from location 1005. Modular spoiler 43 may optionally be replaced at location 1005 or a different modular feature may be placed at location 1005, or modular spoiler 43 may be moved or reoriented at some other location in the channel 10.

In the example apparatus 100 shown in FIG. 11, obliquely-oriented modular foil 40 has a base which is removably and adjustably mounted in the base 24 of the channel, as well as a generally flat or slightly convex inclined leading face 45, a venturi face 46 extending from the leading face 45 and forming a venturi pass 48 with the adjacent side wall 22 of the channel, and a rear face 36. In the illustrated embodiment, each leading face 45 is oriented at a sweep angle $\Phi$ of around 40 degrees to the direction of oncoming water flow in the channel, as best seen in FIG. 11. Leading face 45 is also inclined at a vertical tilt or pitch angle $\acute{\alpha}$ relative to the floor 24 of the channel, as seen in FIGS. 3A and 3B of my co-pending application Ser. No. 12/356,666 filed Jan. 21, 2009, the entire contents of which are incorporated herein by reference. The arrangement and shape of the barreling wave forming modular foil 40 may be similar to the foils described in my prior patents and application referenced above.

The upper edge 38 of each foil 40 may be convex or curved to reduce the risk of injury. The foil height in the illustrated embodiment may be about equal to the height of the outer side walls 18 and greater than the height of channel side walls 22. This height difference helps ensure that at least part of a wave forming in the venturi pass 48 is above the height of the channel walls 22, so that water can drain away from the venturi area 48 and along the river banks 16 to avoid choking or backing up the flow. In one embodiment, the height of the channel wall 22 is around eleven inches below the peak 38 of the modular foil 40, and the channel wall height is around 30 inches. These dimensions are suitable for a 2.5 foot wave, but may be scaled up or down in alternative embodiments, depending on the overall size of the wave forming apparatus. The trailing or rear face 36 is also generally flat and inclined downwardly.

Figure 3:
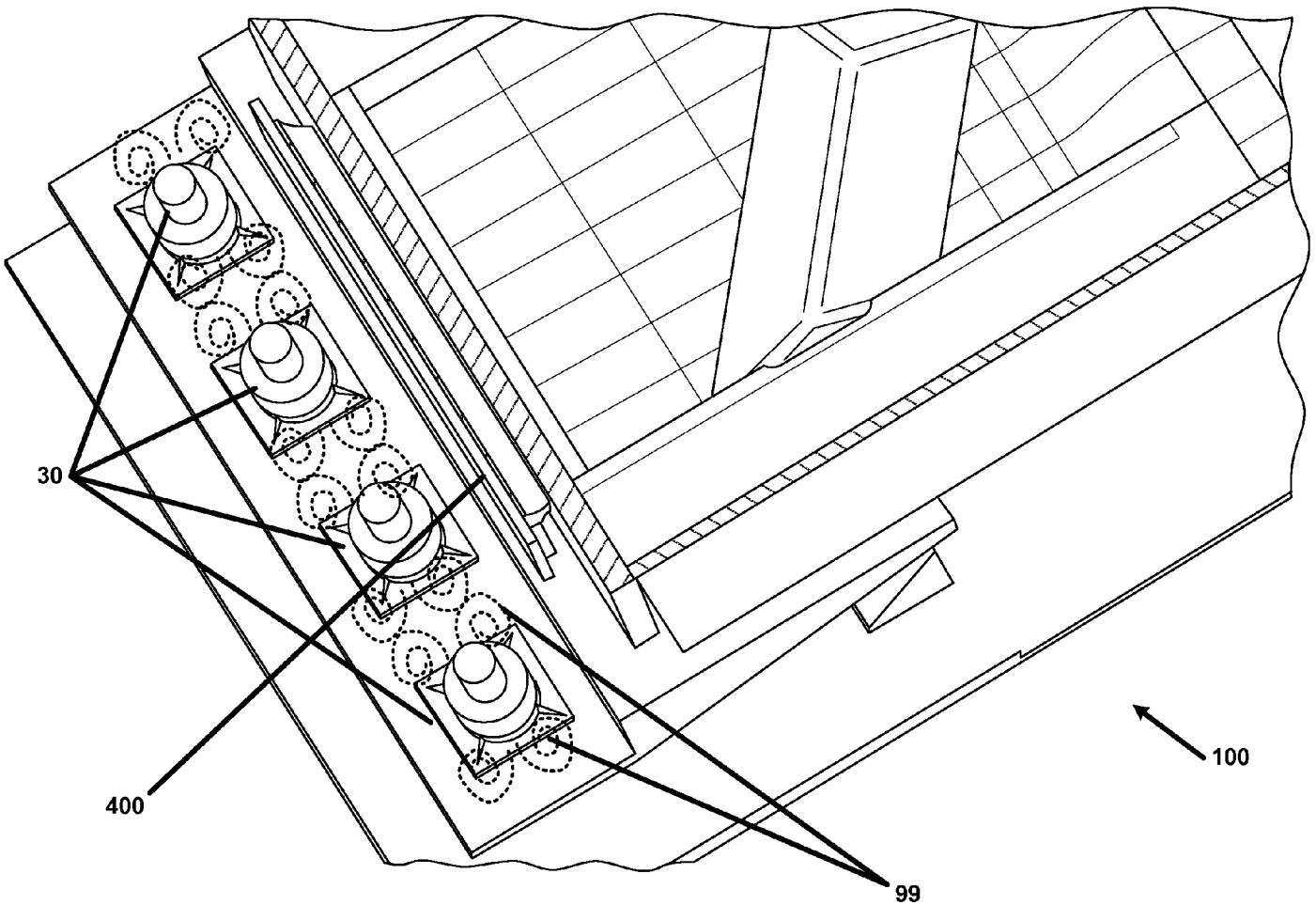
FIG. 3 is a top plan cross-sectional view along the line B-B of FIG. 2, partly cut away, showing pumps and certain areas of turbulent water flow in that embodiment.

The venturi face 46 may start off facing the opposing channel side wall 22 and have a convex curvature leading from the trailing end of the relatively flat leading face 45, then curve rearwardly back towards trailing or rear face 36 and downwardly towards the base of the channel, as shown in the example in FIGS. 3 and 11. Venturi face 46 may have a curved apex that is rounded for safety to avoid a sharp corner, and also to help reduce turbulence in the water flowing around the apex. The optional venturi pass 48 is defined between the leading, convex end of venturi face 46 and the opposing channel side wall, as indicated in FIG. 11. The leading end of face 46 may be inclined away from the channel side wall in a direction upwardly from the floor at a "yaw" angle so that the venturi pass increases in width in a direction upwardly from the base of the channel, as shown in FIG. 11. In the illustrated embodiment, the yaw angle is around 30 degrees, but this angle may range from 90 degrees to 20 degrees in alternative embodiments, dependent on the desired width of the venturi pass, which can be adjusted by moving or repositioning modular foil 40 or adding or subtracting modules of which modular foil 40 is comprised.

As noted above, the peak or top 38 of the modular foil 40 may be convex, such that the peak and inclined downstream or rear face 36 of the foil allow water to stream freely over the foil in this area. The foil peak 38 and downstream foil trailing surface 36 together may allow a relatively smooth and safe transition for riders down into the downstream portion of the channel 10. Although the leading face of the modular foil 40 may have an abrupt or angled intersection with the floor 24 of the channel 10, as seen in FIG. 11, the geometry may alternatively be smoothly blended into the floor for a smooth, curved transition from floor to foil. As can be seen in FIG. 11, the peak 38 defines a longitudinal axis about which the modular foil 40 is substantially symmetrical.

3. Water Smootheners

Figure 7:
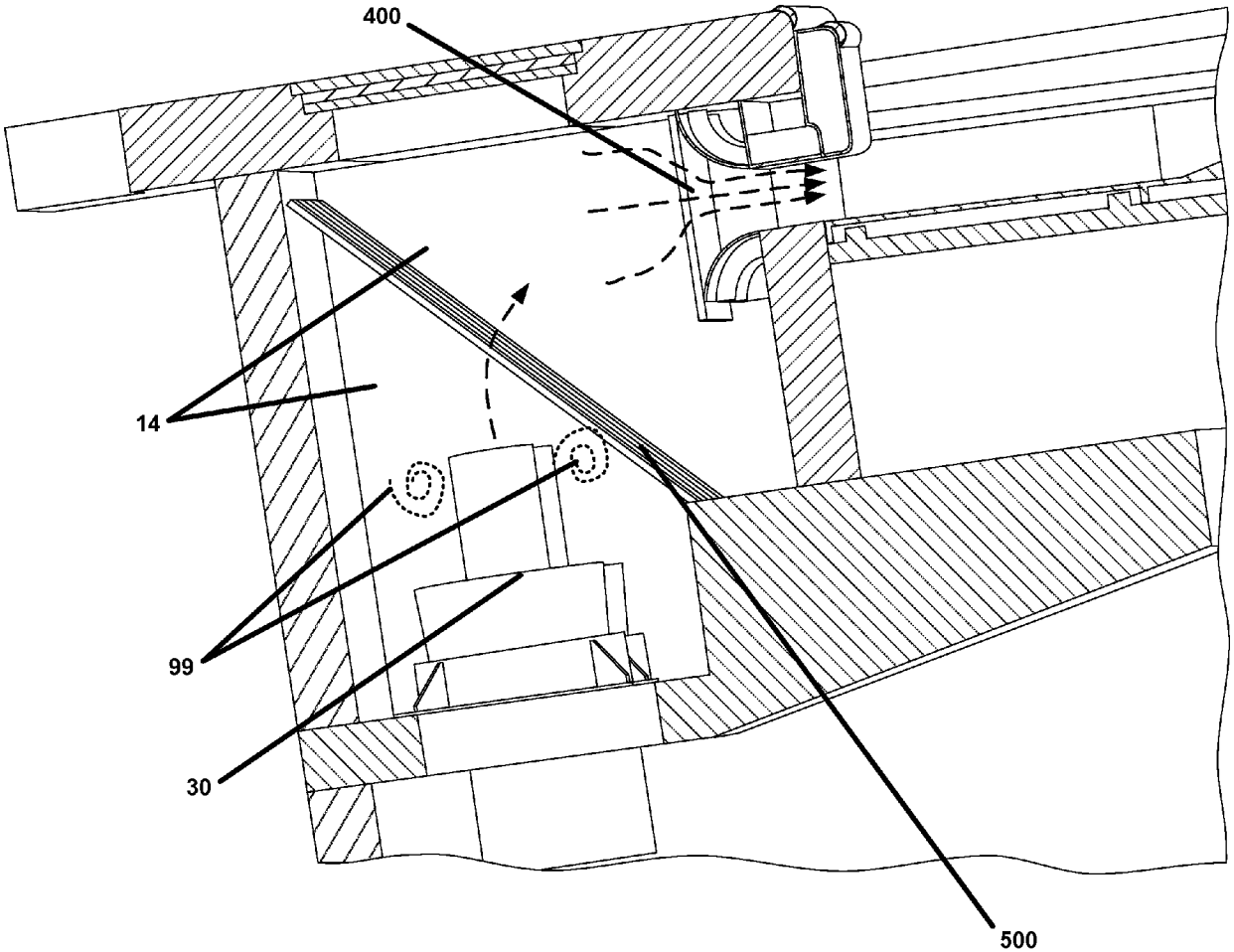
FIG. 7 is a cross-sectional perspective view along the line A-A of FIG. 1, partly cut away, showing an example embodiment with horizontal and angled water smootheners.
Figure 8:
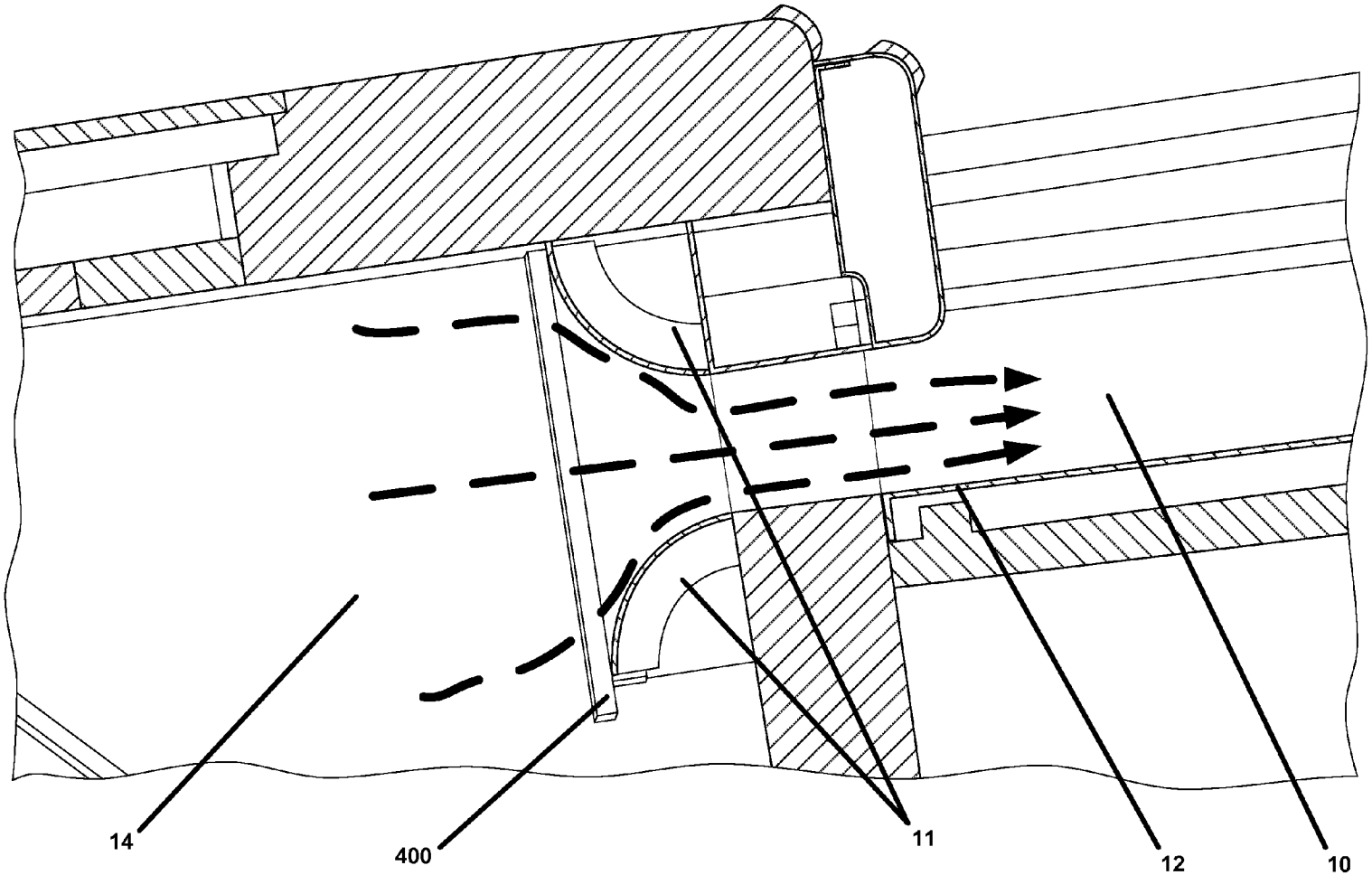
FIG. 8 is a cross-sectional side view along the line A-A of FIG. 1, partly cut away, showing water flow through a horizontal array of water smootheners.

FIG. 8 of co-pending application Ser. No. 12/356,666 filed Jan. 21, 2009 and incorporated herein, schematically illustrates the water flow through a similar channel 10, as indicated by the darker lines, and a surfer 74 riding in the wave. With reference to that figure, water flowing on the right hand side of the channel as viewed from alpha foil 12 flows up and over the leading face 64 of the foil. Water moving towards the venturi face 65 of foil 62 in the left hand part of the channel combines with deflected water from leading face 64 to create a standing barreling wave 72 in front of the venturi face extending laterally into the venturi pass 70. To provide a favorable surfing or wave riding experience for the user and to maintain a well-formed barrel or tube-shaped wave, it is desirable for the water flow through the channel 10 up to the breaking of the wave to be smooth and laminar—"glassy" if possible, not turbulent. However, by their very nature pumps 30 create pressure variations and pulsations in the reservoir 14, which result in turbulent eddy currents in the water that, if not remedied, will flow from reservoir 14 into the channel 10 creating choppy, turbulent water and a resultant poor surfing/wave-riding experience. The occurrence of turbulent eddy currents 99 is depicted in present FIGS. 3, 5 and 7.

Figure 5:
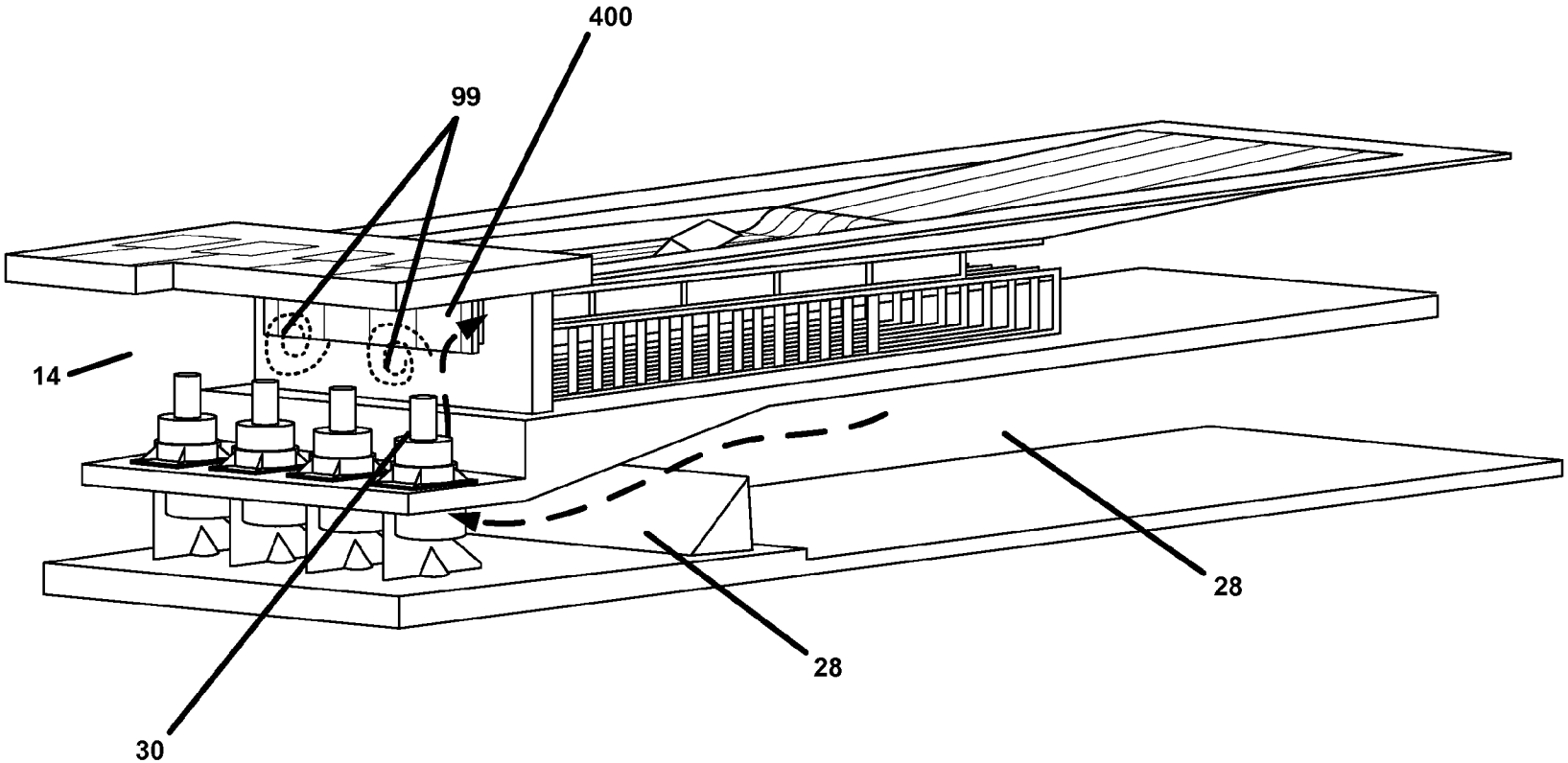
FIG. 5 is a perspective view of the wave forming apparatus of FIG. 1 as cross-sectioned in FIG. 2, showing an example embodiment with only horizontal water smootheners.
Figure 6A:
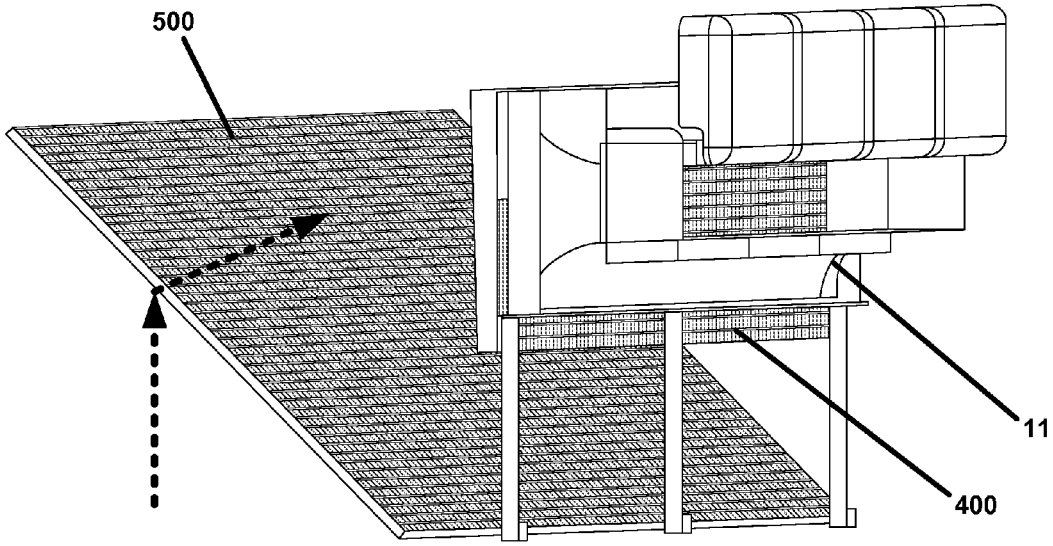
FIG. 6A is a perspective view of two arrays of water smootheners positioned at an example 45 degree angle relative to each other, as used in the embodiment shown in FIG. 4.
Figure 6B:
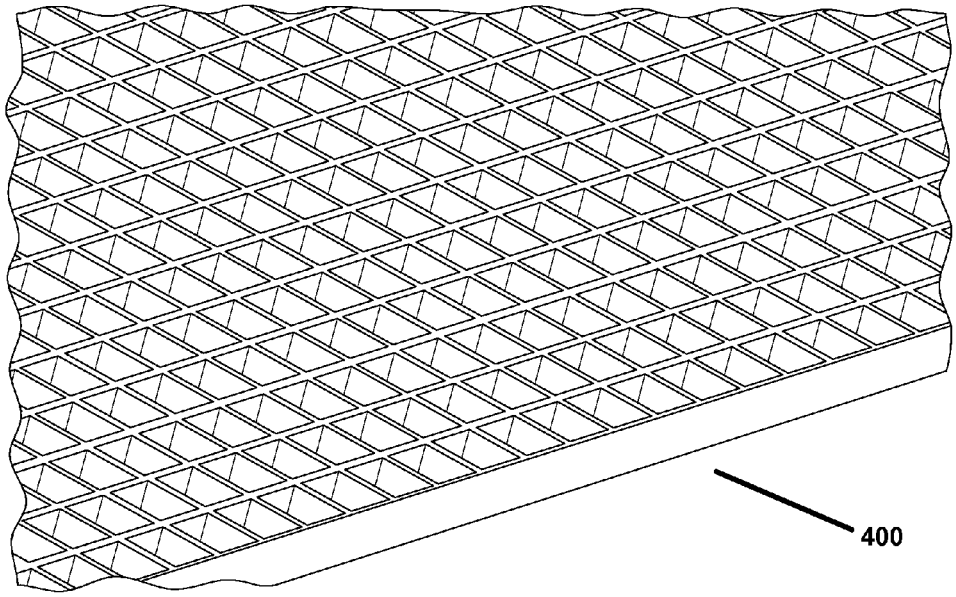
FIG. 6B is a perspective view of an example array of water smootheners, partly cut away.

To partially address this turbulence issue, an apparatus 100 may include one or more smooth radius throat sections 11 guiding water over optional weir 12 and into the channel 10, which tends to have somewhat of a water smoothening effect, as best illustrated in FIG. 8. However, significant eddy currents and resulting turbulence can still pass from reservoir 14 through the relatively large opening of throat sections 11 into the channel 10. To further smoothen the water flow into the channel 10, a first water smoothener 400 may be provided covering the entry of throat sections 11 such that the water flowing from reservoir 14 into throat sections 11 must first pass through smoothener 400, as shown in FIGS. 3, 5 and 8. Water smoothener 400 may comprise any array, matrix, or other assemblage of a plurality of apertures dimensioned to cause water flowing through the apertures to become more laminar. An example smoothener with square apertures is shown in part in FIG. 6B; however, smootheners with round or other shaped apertures can also be used. In one embodiment the square root of the cross sectional area of each aperture is equal to half the distance of the length of each tube or cell (i.e., the depth or thickness of each aperture). Where the apertures are squares, the depth of each tube or cell may be twice the length of one side of the square. In one embodiment the apertures are 2" per side and the depth of the aperture is approximately 4".

Figure 4:
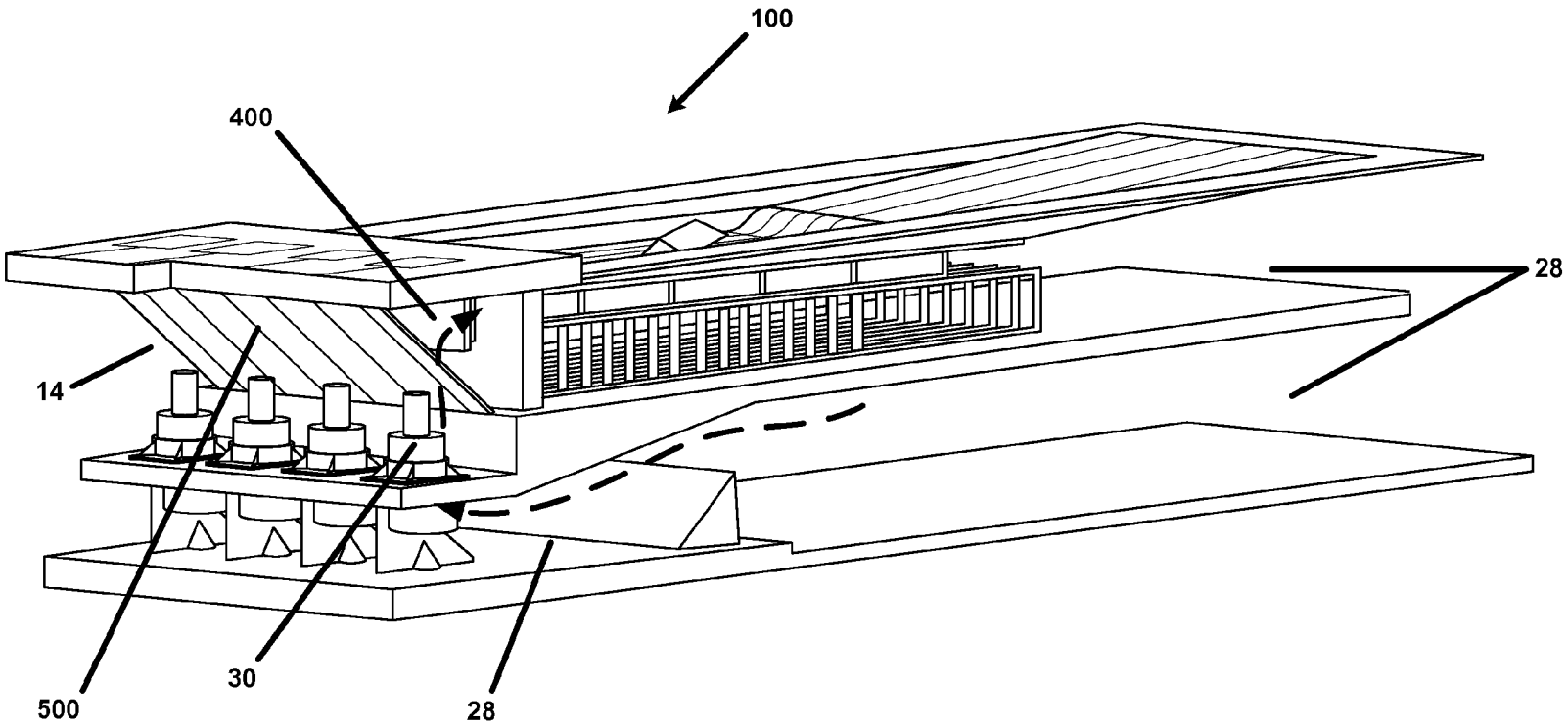
FIG. 4 is a perspective view of the wave forming apparatus of FIG. 1 as cross-sectioned in FIG. 2, showing an example embodiment with horizontal and angled water smootheners.

To provide still smoother water to the channel 10, an additional second water smoothener 500 may optionally be added, as shown in FIGS. 2, 4 and 7. For maximum effectiveness in the embodiment shown in these figures, all the water that reaches smoothener 400 should first pass through smoothener 500. A second smoothener 500 can be especially helpful where the direction of water flow is being changed. Turns in flowing water, especially turns approaching ninety-degree or right turns, tend to cause additional eddy currents and turbulence in the water. It has been found that these turn-induced eddy currents can be lessened by placing multiple smootheners at different points through the turn, such that the smootheners may not be parallel to each other but rather are at an angle with respect to each other. For example, in the embodiments of the apparatus 100 shown herein, the water may be recirculated essentially in a loop, as best shown in FIG. 2, in which case the water must make several ninety-degree turns. Specifically in these example embodiments, the pumps 30 are vertical oriented as that design can be easier and less expensive to manufacture, install, operate and maintain, and can provide lower water speeds than horizontally oriented pumps, which eases the challenge of smoothening the water flow. But in the present example embodiments, water exiting the vertically oriented pumps 30 must make a ninety degree turn within reservoir 14 before entering throat sections 11 and flowing out into the channel 10. Accordingly, adding a second water smoothener 500 to apparatus 100, as shown in FIGS. 2, 4 and 7, and positioning that second water smoothener 500 part-way through the turn, not parallel to the first water smoothener 400 but at an angle thereto (in this case, at a forty-five degree angle), substantially reduces turbulence in the water flowing into the channel 10. Note that water smootheners 400, 500 may be physically attached in one assembly, but if so they still constitute multiple water smootheners for purposes of this specification if individual arrays of apertures are oriented at an angle to one another as described herein.

In these example apparatus, an initial smooth and streamlined flow of relatively deep water enters the channel 10 at foil 12. In one embodiment, the water velocity at the inlet end of the channel is around 12 feet per second while the water depth is around 0.7 feet. In alternative embodiments, the velocity may be in the range of around 8 to 25 fps, and the water depth may be in the range from 0.5 to 3.5 feet. Part of the water in the left hand half of the channel 10 (left hand from the perspective of facing the oncoming flow of water) as viewed in FIG. 2 rises up the leading face 45 and bends laterally towards the venturi pass 48. The water moving in a substantially laminar manner over the leading face 45 is of sufficient depth and velocity to support surfing maneuvers on various types of surfing equipment such as surfboards, bodyboards, and small kayaks known as playboats. At the same time, water moving towards the venturi face 46 of foil 40 combines with deflected water from leading face 45 to create a standing barreling wave in front of the leading face and venturi face extending laterally into the venturi pass 48. Riders can therefore ride in the barrel wave on a surfboard or bodyboard, where the apparatus is used as a water park attraction or ride. Alternatively, the apparatus on a smaller scale can be used for a visual or ornamental water feature (like a fountain) in parks, gardens, and other locations. The opposing channel wall 22 receives some of the water with some spilling onto the river bank 16 and/or running downstream to the grating or drain 26, and then draining into passageway 28 extending under floor 24 where the water is then pumped by pumps 30 back into the reservoir 14, and optionally through smootheners 400 and/or 500 to start the cycle over again.

The stream or flow rate of water arriving at the venturi pass is related to the size of the barreling wave formed at the pass. The faster the incoming rate, the bigger the wave. The venturi pass 48 and venturi face 46 are shaped to impede the flow of water so that the barrel is supported by deeper water through the pass. If the pass is too constricted, the barrel wave drowns and collapses. If the pass is not restricted enough, the barrel is smaller or non-existent, although there is still a surfable wave face in front of the foil 40. The venturi face is positioned close enough to the channel side wall 22 for the water flow to be impeded sufficiently to form a standing barreling wave. In the illustrated embodiment, the width of the venturi pass at the base of the channel is of the order of 37 inches and the overall channel width is around 20 feet. The venturi pass width is varied depending on the size of the channel and foil and the water stream rate characteristics. In general, the venturi pass width is approximately the same as the height of foil 20, and the maximum height of the foil is approximately the same as the desired wave height.

On arriving at the venturi pass 48, the water transitions from its initial shallower, higher speed condition ahead of leading edge of venturi face 45 to a substantially deeper stream above the venturi face and into the venturi pass. After pitching out and forming the barrel, the water lands primarily in the venturi pass area on top of the primary stream. This is a safety advantage, since riders can land in water. The primary stream serves to force the low energy water continuously through the venturi pass and over beta foil 25.

The standing barrel wave created by the above embodiments is like a river wave created at a narrows. The venturi gap 48 simulates a narrows, with the shape of the leading face 45 and venturi face 46 of the barrel wave forming foil 40 enhancing the formation of the standing wave. The tilting away of the leading end of the venturi face 46 from the channel wall 22 provides a bottom contour at which water piles up on top of the foil in a controlled way. The dimensions of the venturi pass 48 together with the design of the venturi face 46 impedes water flow and supports the barrel through the pass 48. The deflection of some of the water flow by the oblique angle and shape of the leading face 45 of the foil 40 creates streamlines with a lateral velocity component towards the venturi gap 48 that collide with streamlines flowing substantially downstream into the venturi pass zone, creating a wave shaped face and a barreling section in the venturi pass 48. Adjustment of the angle of the leading face 45 causes the barreling wave to move across the face 45. At the same time, excess water is allowed to spill out onto the adjacent river bank 16 and run downstream.

By locating the barreling wave generating foil 40 upstream of a spoiler 43 and bed form 25 designed to create a standing wave, two or more different waves may be created in the channel 10 under some flow conditions, or the barreling wave forming foil or foils 40 may be removed from the floor 24 when only a standing wave is desired. Where there are two separate barreling wave forming foils, only one may be deployed so that a barreling wave is formed in one half of the channel with a standing wave downstream extending across at least the other half of the channel. Alternatively, multiple foils 40 may be deployed simultaneously or alternately, and may be at different angles to create different barreling wave effects. This allows for a number of different wave variations to increase participants' interest in the ride. To perform well, however, the water flowing through the channel into the waves must be laminar with minimized eddy currents, which can be achieved at least in part with the system of one or more water smootheners disclosed herein.

Apparatus as described in each of the above embodiments may be scaled up or down depending on the type of water attraction desired. At a smaller scale it is suitable for inner tubing rather than surfing, and at an even smaller scale it may be used for a visual, fountain-like water feature rather than a ride. Larger scales of the apparatus may be used for surfing sports parks and events. The terms foil, airfoil, and aerofoil are understood to have the same meaning for purposes of this patent.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A wave generating apparatus, comprising:

a channel having a first side and a second side separated by a bottom, the channel adapted to direct a flow of water into contact with a first object, the first object removably fastened to the channel so as to be repositioned at different locations on the base of the channel, and located at least partially between the first side and the second side of the channel, the channel and the first object together adapted to generate a standing barreling wave capable of supporting a person surfing when the flow of water contacts the first object;

wherein the first object comprises a leading edge and a vertical plane substantially parallel to the leading edge and the first object is substantially symmetrical about that plane, wherein the vertical plane is positioned at an angle oblique to a primary direction of the flow of the water in the channel, wherein the primary direction is the direction of oncoming water flow in the channel.

2. The wave generating apparatus of claim 1, wherein:

the first object is removably fastenable to the channel in a plurality of locations.

3. The wave generating apparatus of claim 1, wherein:

the first object is removably fastenable to the channel in a plurality of orientations.

4. The wave generating apparatus of claim 1, wherein:

the channel is further adapted to direct the flow of water into contact with a second object removably fastened to the channel and located at least partially between the first side and the second side of the channel.

5. The wave generating apparatus of claim 1, wherein the longitudinal axis is positioned at an angle oblique to a primary direction of the flow of the water in the channel, wherein the primary direction is the direction of oncoming water flow in the channel.

6. The wave generating apparatus of claim 1, wherein:

the first object is located a distance from the first side of the channel, the distance adapted to create a venturi effect between the first object and the first side of the channel when the flow of water contacts the first object, wherein the first object has a leading face extending towards the first side of the channel at an oblique angle to the flow of water.

7. The wave generating apparatus of claim 1, wherein:

the first object is located a distance from the first side of the channel, the distance adapted to create a venturi effect between the first object and the first side of the channel when the flow of water contacts the first object, wherein the first object has a leading face extending towards the first side of the channel at an oblique angle to the flow of water; and the first object is located adjacent the second side of the channel.

8. The wave generating apparatus of claim 1, wherein:

the first object is located a distance from the first side of the channel, the distance adapted to create a venturi effect between the first object and the first side of the channel when the flow of water contacts the first object; and a water drain is located adjacent the first side of the channel.

9. The wave generating apparatus of claim 1, wherein:

the first object is located a distance from the first side of the channel, the distance adapted to create a venturi effect between the first object and the first side of the channel when the flow of water contacts the first object;

a water drain is located adjacent the first side of the channel; and the water drain comprises a water permeable surface adapted to support a person entering or exiting the channel.

10. The wave generating apparatus of claim 1, wherein:

the first object is located a distance from the first side of the channel, the distance adapted to create a venturi effect between the first object and the first side of the channel when the flow of water contacts the first object;

a first water drain is located adjacent the first side of the channel;

a second water drain is located adjacent the second side of the channel; and the first and second water drains comprise a water permeable surface adapted to support the person entering or exiting the channel.

11. A modular device for forming a barreling wave within a channel, the channel adapted to direct a flowing stream of water, the device, comprising:

an airfoil shaped member having a leading edge, a front face, a rear face, a peak, and a base, the member having a vertical plane substantially parallel to the leading edge and the member is substantially symmetrical about that plane, the modular device adapted to be removably fastened to the channel so as to be repositioned at different locations on the channel , such that the vertical plane is positioned at an angle oblique to a primary direction of the water stream the modular device further adapted to generate a standing barreling wave when the modular device is mounted in a first location in the channel and the flowing stream of water contacts the modular device.

12. The modular device of claim 11, wherein:

the modular device is further adapted for removably mounting in a second location in the channel.

13. The modular device of claim 11, wherein:

the modular device is further adapted for removably mounting in a first orientation in the channel.

14. The modular device of claim 11, wherein:

the modular device is further adapted for removably mounting in a first orientation in the channel; and is further adapted for removably mounting in a second orientation in the channel.

15. The modular device of claim 11, wherein:

the modular device comprises a plurality of sections adapted to be repeatedly assembled and disassembled with each other to change the size or shape of the modular device.

16. A method of forming a standing barreling wave, comprising:

positioning a removable member to project upwardly from a first location in the base of a channel with the removable member at a first predetermined orientation to a water stream direction defined by the channel, the member comprising a leading edge and a vertical plane substantially parallel to the leading edge and the member is substantially symmetrical about that plane wherein the vertical plane is positioned at an angle oblique to the water stream direction;

supplying a flowing stream of water to an inlet end of the channel towards the removable member;

whereby a standing barreling wave is formed when at least part of the water stream contacts the member; and positioning the member at different locations on the base of the channel.

17. The method of claim 16, further comprising:

repositioning the removable member to project upwardly from a second location in the base of the channel with the removable member at the first predetermined orientation to a water stream direction defined by the channel;

supplying the flowing stream of water to the inlet end of the channel towards the removable member;

whereby a standing barreling wave is formed when at least part of the water stream contacts the member.

18. The method of claim 16, further comprising:

repositioning the removable member to project upwardly from the first location in the base of the channel with the removable member at a second predetermined orientation to the water stream direction defined by the channel;

supplying the flowing stream of water to the inlet end of the channel towards the removable member;

whereby a standing barreling wave is formed when at least part of the water stream contacts the member.

19. The method of claim 16, further comprising:

repositioning the removable member to project upwardly from a second location in the base of the channel with the removable member at a second predetermined orientation to the water stream direction defined by the channel;

supplying the flowing stream of water to the inlet end of the channel towards the removable member;

whereby a standing barreling wave is formed when at least part of the water stream contacts the member.

* * * * *